United States Patent [19]

Sugiyama et al.

[11] Patent Number: 4,702,989

[45] Date of Patent: Oct. 27, 1987

[54] PROCESS FOR PRODUCING PRESSURE-FIXABLE ELECTROPHOTOGRAPHIC TONERS

[75] Inventors: Norihide Sugiyama; Katsuro Funato, both of Shizuoka; Hiroshi Nagase, Tokyo; Seiichi Yamamoto, Tokyo; Shigeo Miyamori, Tokyo, all of Japan

[73] Assignee: Fujikura Kasei Co., Ltd., Tokyo, Japan

[21] Appl. No.: 849,369

[22] Filed: Apr. 7, 1986

Related U.S. Application Data

[63] Continuation-in-part of Ser. No. 634,864, Jul. 26, 1984.

[30] Foreign Application Priority Data

Jul. 26, 1983 [JP] Japan ..... 58-135075
Mar. 12, 1984 [JP] Japan ..... 59-46951

[51] Int. Cl.[4] ..... G03G 11/00

[52] U.S. Cl. ..... 430/137; 430/98; 428/402.24

[58] Field of Search ..... 430/137, 98; 428/402.24

[56] References Cited

U.S. PATENT DOCUMENTS 3,691,090 9/1972 Kitajima et al. ..... 427/213.36
3,893,932 7/1975 Azar et al. ..... 430/109
3,943,063 3/1976 Morishita ..... 427/213.36

OTHER PUBLICATIONS

Castellan, Physical Chemistry, Addison-Wesley, p. 279.

*Primary Examiner*—J. David Welsh
*Attorney, Agent, or Firm*—Wenderoth, Lind & Ponack

[57] ABSTRACT

A pressure-fixable toner is produced by: dispersing or dissolving a mixture containing (a) a colorant and/or magnetic particles, (b) a pressure fixable binding material, and (c) a capsule wall-forming resin, in an organic solvent; dispersing the resulting dispersion or solution in a dispersion-stabilizing solution; heating the dispersion to evaporate off the solvent; dispersing the resulting encapsulated toner in a lower alcohol to remove the solvent remaining within the encapsulated toner; and thereafter drying the toner. The toner can be used to develop images in electrophotographic systems.

8 Claims, No Drawings

PROCESS FOR PRODUCING PRESSURE-FIXABLE ELECTROPHOTOGRAPHIC TONERS

This application is a continuation-in-part of now abandoned application Ser. No. 634,864, filed July 26, 1984.

BACKGROUND OF THE INVENTION

This invention relates to a toner which is used to render visible an electric latent image or a magnetic latent image in electrophotographic processes, magnetic recording processes and the like, and more particularly to an encapsulated toner having an excellent pressure-fixable property.

Electrophotographic processes are image forming processes wherein a photoconductive phenomenon within solids is utilized to use a physical process or electron phenomenon. The electrophotographic processes are classified into xerographic, electrofax and persistent internal polarization modes and the like.

The xerographic process comprises the steps of applying an electrical charge to a photoconductive photoreceptor by means of a corona discharge or the like, then exposing the photoreceptor to light to form an electrostatic latent image, developing this latent image with fine grains, transferring the developed image to paper or some other material, and then fixing the transferred image.

While the principle of the electrofax process is the same as that of the xerographic process, it is characterized in that a photoconductive paper is used. The electrofax process comprises the steps of applying an electric charge to the surface of the photoconductive paper thereby to electrostatically charge the same, exposing it to light to form an electrostatic latent image, developing the latent image with fine grains, and then fixing it to form an image.

In any of the electrographic processes or the magnetic recording processes wherein the latent image is magnetically formed, a toner is used in rendering the latent image visible. A two-component development process wherein a mixture of toner and carrier particles is used and a single component development process wherein no carrier particles are used are known as the processes for rendering the latent image visible with the toner.

The image thus developed with the toner is transferred onto a recording support such as paper as needed, and thereafter a step for fixing a toner is provided in order to form a storable image. The fixing step is broadly classified into a heat-fixing process, a solvent-fixing process, and a pressure-fixing process.

In the heat fixing process, a toner image is melted and secured onto a recording support by means of heated rollers or a heating chamber to fix the same. Accordingly, it is necessary to provide a heat source. Further, in some cases it may be necessary to provide separately an apparatus for eliminating excess heat accumulated within the image forming apparatus. Furthermore, there are problems such as unavoidable enlargement of the image forming apparatus or increase of the amount of electric power used. In addition, in the heat fixing process, it is difficult to carry out high speed fixing because some time is required for melting the toner components.

In the solvent fixing process, a toner image is dissolved and secured onto a recording support by means of a solvent to fix the toner image. In this solvent fixing process, it is necessary that the solvent used be thoroughly removed from the fixed surfaced or support, and much labor is required to manage the toxicity, inflammability, odor, etc. of the solvent.

In order to solve the technical drawbacks accompanying the heat-fixing process or the solvent fixing process, a pressure-fixing process wherein a toner image formed on a recording support is fixed by pressure has been proposed and is attracting much attention. According to this pressure fixing process, the fixing of an image is carried out at the time when a recording support having a toner image formed thereon is passed between a pair of rollers. As a result, it is possible to carry out high speed fixing, and a heat source and electric power for heating are unnecessary.

However, according to the prior art pressure-fixing processes, a linear pressure as high as from 20 to 40 Kg/cm is generally required to fix a toner image, and therefore it is difficult to reduce the size and weight of the light image forming apparatus. Further, the recording support in some cases in the past has wrinkled or curled, and the strength of the paper has been reduced. Furthermore, since the image is formed by applying pressure to a particulate toner, the surface of the resulting image in some instances has disadvantageously been smoothed and become lustrous.

In order to solve the problems accompanying such a pressure-fixing process, the use of materials having a low softening point or melting point and having a low pressure-fixable property as a toner has been proposed. A toner comprising materials having a low softening point or melting point is accompanied by the following problems: interparticle agglomeration or blocking may occur during storage; the toner particles adhere to the interior of the image forming apparatus to contaminate the interior of the apparatus; and further when the toner fixed to the recording support is stored under some pressure, the toner adheres to the back of another support to cause damage or breakage of the image as well as the support.

Accordingly, a variety of encapsulated toners in each of which a low pressure-fixing material is used as a core and the outer surface of this material is coated with a resin which satisfies the characteristics required for toner powders to provide the core with an outer wall have been proposed.

The following toners have been proposed as these encapsulated toners.

(1) Double wall capsules obtained by providing the outer surface of a core material having a pressure-fixable property with a first wall comprising a hydrophilic film-forming polymeric material by a coacervation process or the like to form first capsule particles, dispersing the first capsule particles in an emulsion of various resins, and thereafter carrying out spray drying to provide the surface of the first capsule particles with a second wall comprising the resin described above, wherein colorants or magnetic particles are admixed into the core material or the outer wall described above (as disclosed in, for example, Japanese Patent Laid-Open Pub. No. 104829/1976, Japanese Patent Laid-Open Pub. No. 122449/1976, Japanese Patent Laid-Open Pub. No. 124934/1976, Japanese Patent Laid-Open Pub. No. 1028/1978, Japanese Patent Laid-Open Pub. No. 36243/1978, Japanese Patent Laid-Open Pub. No.

124435/1976, Japanese Patent Laid-Open Pub. No. 132838/1976, and Japanese Patent Laid-Open Pub. No. 113740/1977).

(2) Toners obtained by dispersing a core material having a pressure-fixable property as well as a constant particle size (from 3 to 25 microns) in a solution or emulsion of various resins and thereafter carrying out spray drying to provide the surface of the core material described above with an outer wall (as disclosed in, for example, Japanese Patent Laid-Open Pub. No. 18655/1980, Japanese Patent Laid-Open Pub. No. 89854/1980, Japanese Patent Laid-Open Pub. No. 166653/1980, Japanese Patent Laid-Open Pub. No. 89855/1980, and Japanese Patent Laid-Open Pub. No. 64349/1981).

(3) Toners obtained by providing the outside of a core material having a pressure-fixable property with an outer wall of resins such as melamine/formaldehyde resin, polyurethane resin or polyurea resin (as disclosed in, for example, Japanese Patent Laid-Open Pub. No. 142362/1980, Japanese Patent Laid-Open Pub. No. 21259/1983, Japanese Patent Laid-Open Pub. No. 66948/1983, Japanese Patent Laid-Open Pub. No. 66950/1983, Japanese Patent Laid-Open Pub. No. 68753/1983, and Japanese Patent Laid-Open Pub. No. 100855/1983).

However, the prior art encapsulated toners described above are accompanied by the following problems.

(a) In the case of the double wall capsule (1) described above, the first and second walls are provided on the core material in producing the toner, and therefore two steps are required. Accordingly, the production steps are complicated.

(b) In the case of the encapsulated capsule (2) described above, pulverization and classification steps are required in order to adjust the core material to a constant particle size (from 3 to 25 microns).

(c) In the case of the encapsulated toner (3) described above, it is necessary to use a solvent in which the core material is mixed, dispersed or dissolved, and in which one component of the wall materials is dissolved. This solvent remains in the encapsulated toner and adversely affects the toner characteristics. When no solvent is used, it is difficult to finely disperse the highly viscous mixture comprising the core material and one component of the wall material to the particle diameter required for the toner.

(d) Since the toners (1) and (2) described above are both dried by a spray drying process, these processes are advantageous in that the bulk of the dispersion medium can be removed in a short period of time. However, the agglomeration of particles due to their mutual collision in the spray drying step cannot be avoided, whereby it is difficult to obtain a toner having a particle size of from 5 to 30 microns in high yields.

Moreover, it is impossible to avoid perforation of the outer wall accompanying the rapid removal of the dispersion medium from the outer wall. If the outer wall of the toner becomes porous, the core material of the toner will leach out of the pores present in the outer wall, and consequently the toner particles will exhibit agglomeration or blocking to impair the toner fluidity. Thus, a porous outer wall is undesirable.

When an organic solvent is used as the dispersion medium or the like, the organic solvent evaporates off in the spray drying step. Therefore, the use of an organic solvent is undesirable because of hazards such as electrostatic explosion and toxicity. Further, the solvent must be thoroughly removed from the resulting toner.

(e) In any of the toners (1), (2) and (3) described above, it is necessary to control the particle size of the toner to be within an optimum range in the production steps. However, since the resin used for the outer wall is a cross-linking resin, inferior toners cannot be reused and thus pose economical problems.

(f) In the toners (1), (2) and (3) described above, when the amount of the toner electrically charged is adjusted, a charge control agent is confined within the particles of the encapsulated toner in any of the processes for producing the toners described above. However, the electrical charge characteristics of the toner particles primarily depend upon electrical characteristics of the outer surface of the toner particles. Accordingly, the processes for controlling the electrical charge according to the prior art are not necessarily effective processes. Therefore, in order to obtain ample charge-controlling characteristics, it is necessary to use a large amount of a relatively expensive charge control agent. Further, it is difficult to produce the toner in a manner such the charge characteristics of the toner will not deviate between production lots.

SUMMARY OF THE INVENTION

In view of the problems described above, we have carried out studies directed toward overcoming them. An object of the present invention is to provide a process for producing an encapsulated toner having the following advantages:

(a) the production steps are simplified;

(b) the toner has a stable particle size distribution;

(c) it is possible to reuse the off-specification encapsulated toner;

(d) interparticle agglomeration or blocking does not occur during storage;

(e) the shape of the particles is approximately spherical, and moreover the surface is smooth, the fluidity of the particles being high;

(f) the capsule wall is not ruptured in steps such as the classification step, the step for mixing with a carrier, and the feeding step within the image forming apparatus, but the capsule wall is ruptured for the first time in the pressure-fixing step, the toner having an excellent pressure-fixable property;

(g) there is no offset onto a pressure roller;

(h) no fogging phenomenon occurs, and the resolving power is excellent, the toner providing a high grade image;

(i) the electrical charge characteristics of the toner are uniform between lots; and (j) the toner can be fixed under a low fixing pressure.

The present process comprises the following steps:

(1) dispersing or dissolving a starting material mixture containing (a) a colorant and/or magnetic particles, (b) a pressure-fixable binding material, and (c) a capsule wall-forming resin in an organic solvent;

(2) dispersing the resulting dispersion or solution in an aqueous dispersion-stabilizing solution;

(3) then gradually heating the thus-obtained dispersion up to the azeotropic temperature of the water-organic solvent thereby driving off the organic solvent from the dispersed droplets and phase-separating the capsule wall-forming resins dissolved in the organic solvent on the surface of the dispersed toner droplets containing components (a) and (b) to form a capsule wall around the surface of the droplets;

(4) dispersing the resulting encapsulated toner in a lower alcohol thereby to remove said organic solvent contained within the encapsulated toner; and (5) drying the encapsulated toner.

The toner particle produced by the present process has a structure in which a mixture of particles containing a colorant and a pressure-fixable binding material is substantially encapsulated with a capsule wall-forming resin. This capsule wall-forming reaction seems to occur substantially in the above-mentioned step (3). In this respect, the above step (3) is very important indeed.

DETAILED DESCRIPTION OF THE INVENTION

A starting mixture which is used for the production of a pressure-fixable toner of the present invention contains (a) a colorant and/or magnetic particles, (b) a pressure-fixable binding material, and (c) a capsule wall-forming resin.

A variety of pigments or dyes known in the art can be widely used as the colorant. Examples of the colorants include the following compounds:

(a) carbon black;
(b) iron black;
(c) Nigrosine dye;
(d) aniline blue;
(e) chalco oil blue;
(f) chrome yellow;
(g) chrome green;
(h) ultramarine blue;
(i) cobalt blue;
(j) Du Pont Oil Red;
(k) benzyl yellow;
(l) Quinoline Yellow;
(m) Methylene Blue chloride;
(n) Phthalocyanide Blue or Phthalocyanide Green;
(o) Malachite Green;
(p) oxalate;
(q) lamp black; and
(r) Rose Bengale.

These colorants can be used singly or as mixtures thereof.

The magnetic particles are of materials exhibiting magnetic or magnetizable character. The magnetic particles are powders of ferromagnetic elements, or compounds or alloys containing such ferromagnetic elements. Examples of these magnetic particles are:

(a) magnetite;
(b) ferrite;
(c) powders of metals such as iron, manganese, nickel, and cobalt;
(d) powders of compounds containing metals such as iron, manganese, nickel and cobalt; and
(e) powders of alloys containing metals such as iron, manganese, nickel and cobalt.

These magnetic particles can be used singly or as mixtures thereof.

By the term "pressure-fixable binding material" which is used in the present invention is meant a natural or synthetic material which is readily deformed by pressure applied thereto and secured to the surface of a recording support, the adhesiveness to the support being good after securing, and which generally has a low softening point or a melting point. While such pressure-fixable materials include the following materials, they are not limited thereto.

(a) Higher fatty acids such as stearic acid, palmitic acid, myristic acid, lauric acid, and capric acid;

(b) Metallic salts of higher fatty acids such as aluminum, lead, barium and zinc salts of higher fatty acids such as stearic acid, palmitic acid, myristic acid, lauric acid, and capric acid;

(c) Derivatives of higher fatty acids such as hydrogenated castor oil, hydrogenated coconut oil, methylhydroxystearate, and glycerol monohydroxystearate;

(d) Amides of higher fatty acids such as octadecane amide, hexadecane amide, dodecane amide, octane amide, and hexane amide;

(e) Natural waxes such as paraffin wax, microcrystalline wax, montan wax, beeswax, and Japan wax;

(f) Synthetic waxes such as polyethylene wax, and polyethylene oxide wax;

(g) Rosin derivatives such as rosin, and hydrogenated rosin, rosin ester;

(h) Polyolefins such as low molecular weight polyethylene, low molecular weight polypropylene, polyethylene oxide, polyisobutylene, and polytetrafluoroethylene;

(i) Olefin copolymers such as ethylene-acrylic acid copolymer, ethylene-methacrylic acid copolymer, ethylene-vinyl acetate copolymer, ethylene-vinyl alkyl ether copolymer, and ethylene-methacrylate copolymer;

(j) Resins such as silicone resin, alkyd resin, natural resin-modified phenol resin, maleic acid-modified, and phenol resin;

(k) Rubbers such as isobutylene rubber, nitrile rubber, and chlorinated rubber; and (l) Styrene resins such as low molecular weight polystyrene, styrene-butadiene copolymer, and styrene-acrylic compound copolymer.

These pressure fixable binding materials can be used singly or as mixtures thereof.

Further, petroleum resins obtained by polymerizing unsaturated hydrocarbons comprising aliphatic olefin and/or diolefin which have been obtained in a pyrolysis process of petroleum naphtha can be used in combination with the pressure fixable binding material. The unsaturated hydrocarbons comprise preferably $C_5$ hydrocarbons.

It is preferable that such petroleum resins have a softening point of from 65° to 110° C. When the softening point is less than 65° C., the tackiness is excessive, whereby an offsetting phenomenon onto a fixing roller is apt to occur. When the softening point is above 110° C., the tackiness is reduced, whereby the fixable property of the toner is impaired. Accordingly, a petroleum resin having a higher or lower softening point is undesirable.

The petroleum resins may be included in the pressure-fixable binding material at levels of from 0% to 60% by weight, preferably 20% to 60% by weight. When the amount is over 60% by weight, the plasticity is reduced, whereby the fixable property of the toner is impaired, since tangles of the toner with paper fibers are reduced.

As the capsule wall-forming resin, (a) homopolymer of styrene or vinyl monomer, (b) copolymer of styrene and vinyl monomer and (c) epoxy resins are preferably used. More preferably, polymers or copolymers consisting of from 50 to 100 parts by weight of styrene and from 0 to 50 parts by weight of vinyl monomers are used.

Examples of such vinyl monomers for use in the present invention are methyl (meth)acrylate, ethyl (meth)acrylate, (iso)butyl (meth)acrylate, (cyclo)hexyl (meth)acrylate, ethylhexyl (meth)acrylate, lauryl (meth)acrylate, stearyl (meth)acrylate, vinyl acetate, vinyl propionate, (meth)acrylonitrile, dimethyl maleate, diethyl maleate, dimethyl fumarate, dibutyl fumarate, dimethyl itaconate, dibutyl itaconate, methyl vinyl ether, ethyl vinyl ether, n-butyl vinyl ether, and isobutyl ether. These vinyl monomers can be used singly or as mixtures thereof.

In order to improve the toner characteristics such as pressure-fixable property and storage stability, it is preferable that the glass transition temperature of the capsule wall-forming resin described above be in the range of from 50° to 90° C., and that the weight average molecular weight thereof be in the range of from 30,000 to 300,000. That is, when the glass transition temperature is below 50° C., the storage stability of the toner decreases, and a blocking phenomenon tends to occur. On the other hand, when the glass transition temperature is above 90° C., the pressure-fixable property decreases. When the weight average molecular weight is less than 30,000, the storage stability of the toner is insufficient. On the other hand, when the weight average molecular weight is more than 300,000, the pressure-fixable property decreases.

The epoxy resins which can be used as the capsule wall-forming resin mean polymeric materials having at least two epoxy groups in molecule, and synthetic compounds formed by cleavage reaction of such epoxy groups. The epoxy resins which can be more preferably used in the present invention are the polymeric materials having at least two epoxy groups in molecule. Such epoxy resins are cured by causing the cleavage and addition reactions of the epoxy group by means of amine curing agents and the like, and thus the outside of the core material is provided with a wall of higher molecular weight cured epoxy resin.

Bisphenol A-type epoxy resins, resorcinol-type epoxy resins, bisphenol F-type epoxy resins, novolak-type epoxy resins and the like can be used as such epoxy resins. These epoxy resins can be used alone or in admixture.

Compounds capable of forming crosslinkage via the cleavage and addition reactions of the epoxy group present in the epoxy resins can be used as the curing agent for epoxy resins. In general, amines, acid anhydrides or organic acids are used as the curing agent. The amines are particularly preferred.

Examples of the amine curing agent are the following compounds:

(a) linear aliphatic polyamines;
(b) cyclic aliphatic polyamines;
(c) aliphatic polyamine addition products;
(d) hetomines;
(e) modified aliphatic polyamines;
(f) modified polyamines;
(g) polyamide-amines;
(h) aromatic amines;
(i) aromatic modified amines; and
(j) aromatic modified polyamines.

These amine curing agents can be used alone or in admixture.

For the purpose of acceleration of the curing reaction of such epoxy resins, for example, compounds such as tertiary amines, phenols, boron trifluoride-amine complexes and imidazoles can be used with the above curing agent for epoxy resins.

The curing agents for epoxy resins and the curing accelerators described above are incorporated in the dispersion-stabilizing solution and used. The amount of the curing agent incorporated in the dispersion-stabilizing solution is from 20 to 200 parts by weight, and desirably from 50 to 170 parts by weight based on 100 parts by weight of epoxy resins. When the amount of the curing agent is less than 20 parts by weight, the curing reaction becomes incomplete and thus the product cannot be separated as granules. When the amount of the curing agent is more than 200 parts by weight, no advantage is obtained and therefore such amounts are not preferred.

When the epoxy resin is used as the capsule wall-forming resin, the capsule wall is formed from a crosslinking resin, and therefore the rejected toner cannot be readily reused.

It is necessary that the organic solvent satisfy the following requirements: (a) it is capable of dissolving or dispersing the pressure-fixable binding material and the capsule wall-forming resin; (b) it is not readily evaporated in dispersing or mixing the colorant and the magnetic particles, and the organic solvent can retain a stable dispersion state in a dispersion-stabilizing solution; and (c) the organic solvent is a hydrophobic organic solvent having a boiling point of at least about 100° C. Toluene is preferably used as the organic solvent satisfying such requirements, which is advantageous in handling, safety, and cost, and which can be evaporated off by an azeotrope with water.

The dispersion-stabilizing solutions for use in the present invention are those capable of stably dispersing the dispersion or solution in which toner starting materials have been dissolved or dispersed in the organic solvent described above. Examples of such dispersion-stabilizing solutions for use in the present invention are: a 0.05–3% aqueous solution, preferably 0.3–2.0% aqueous solution, containing hydrophilic colloidal materials such as gelatin, gum arabic, polyvinyl alcohol, hydroxyethyl cellulose, sodium salt of carboxymethyl cellulose, and sodium salt of poly(meth)acrylic acid; and a 0.01–5% aqueous solution, preferably 1.0–3.0% aqueous solution, containing hydrophilic inorganic colloidal materials such as colloidal silica, calcium phosphate, and aluminum hydroxide. Further, a 0.01–2% aqueous solution, preferably 0.05–1.0% aqueous solution, containing anionic surfactants or non-ionic surfactants suitable for preparing oil-in-water type dispersion system is used as the dispersion-stabilizing solution. These dispersion-stabilizing solutions can also be used singly or as mixtures thereof.

Methanol, ethanol, normal propyl alcohol, isopropyl alcohol and the like can be used as the lower alcohol used in the step for removing the organic solvent contained in the encapsulated toner.

In the present invention, charge control agents can be used as needed. Such charge control agents incorporated into a capsule wall are classified into those for positive charge and those for negative charge. Nigrosine dyes, metal salts of naphthenic acid or higher fatty acids, alkoxylated amines, quaternary ammonium salts, alkyl amides, and the like can be used as the charge control agent for positive charge. Various organic complexes, chlorinated paraffins, chlorinated polyesters and the like can be used as the charge control agent for negative charge.

The process for producing a pressure-fixable toner according to the present invention will now be described.

When the pressure-fixable toner is to be used as a two-component developer in combination with carrier particles, a starting mixture containing (a) a pressure-fixable binding material, (b) a colorant, and (c) a capsule wall-forming resin is dispersed or dissolved in organic solvents such as toluene; the resulting dispersion or solution is formed into a paste in the manner well-known in the art by means of a sand mill, a ball mill, an attritor, or the like; and an organic solvent is further added to the paste to prepare a dispersion or solution having a low viscosity.

When the toner is to be used as a single component developer without using it in combination with carrier particles, the starting mixture containing (a) a pressure-fixable binder, (b) magnetic particles (and a colorant as needed), and (c) a capsule wall-forming resin is treated in the same manner as described above.

The quantitative ratios of the pressure-fixable binding material to the capsule wall-forming resin are as follows. In the former case, wherein the toner is used as the two-component developer, it is preferable to use from 60 to 85 parts by weight of the pressure-fixable binding material and from 15 to 40 parts by weight of the capsule wall-forming resin. In the latter case, wherein the toner is used as the single component developer, the amount of the capsule wall-forming resin is from 5 to 40 parts by weight, preferably from 5 to 30 parts by weight per 10 parts by weight of the pressure fixable binding material. The capsule wall-forming resins used herein may be also those obtained by polymerizing in an organic solvent.

The organic phase obtained by dispersing or dissolving the starting mixture in the organic solvent is then dispersed dropwise into a dispersion-stabilizing solution which is stirred at a rate of from 800 to 10,000 revolutions per minute, and the particle size of the dispersed droplets is adjusted to a size of the order of from 5 to 30 microns.

The thus obtained dispersion is then gradually warmed to the azeotropic temperature of the water-organic solvent to drive off the organic solvent, cooled, and then separated by filtration. The resulting encapsulated toner particles formed as previously discussed are dispersed in a lower alcohol for about one hour to extract and remove the organic solvent contained within the toner. The toner is then separated by filtration.

If it is desired to impart specific charge characteristics to the toner, a charge control agent is previously dissolved or dispersed in a lower alcohol as needed. Thus, the charge control agent can be adsorbed onto the surface of the toner particles. According to this process, the amount of the charge control agent used is one half or less as compared with that used in the process wherein the charge control agent is admixed into core materials or wall materials, and it is possible to obtain the same charge control effect as that of the prior art.

The encapsulated toner obtained by filtration is dried in an air stream at 30° to 50° C. and thereafter classified.

The process for producing pressure-fixable toners according to the present invention has the following advantageous effects.

(a) The production steps are simple as compared with the prior art, and it is possible to shorten the process time.

(b) The fixable property of the resulting toner is excellent.

(c) The particle size of the resulting toner is in the range of from 5 to 30 microns, and the toner has excellent uniformity of the particle size distribution.

(d) The shape of the resulting toner particles is approximately spherical, the surface being smooth, and the toner has high fluidity.

(e) Because the off-specification toner by classification can be recovered and reused as a starting material of toners, the present process is economically advantageous.

(f) The amount of the charge control agent used can be decreased, and therefore it is possible to lower the production cost.

(g) No offset onto the pressure rollers is observed.

(h) Because the shape and particle size of the toner particles are uniform, no fogging phenomenon is observed, and high grade images exhibiting excellent resolving power are obtained.

(i) It is possible to carry out fixing under a low fixing pressure.

While the present invention is described more fully below by Examples, the present invention is not limited in scope to these Examples.

EXAMPLE 1

65 grams of microcrystalline wax (produced by PEROLITE Company under the trade name ULTRA-FLEX and having a melting point of 62° C.), 5 grams of carbon black (produced by Mitsubishi Kasei, K.K., Japan, under the trade name Mitsubishi Carbon MA-100), and 35 grams of a copolymer consisting of 80 parts by weight of styrene and 20 parts by weight of methyl methacrylate and having a number-average molecular weight of 80,000, were added to 100 grams of toluene and dissolved or dispersed therein at a temperature of 50° C.

The materials were further dispersed in toluene by using DYNO-MILL (manufactured by Widly A. Bachofen Engineering Works), and then 100 grams of toluene was added to prepare a toluene solution. This toluene solution was placed in a dropping funnel. A 1.5 liter cylindrical flask equipped with a stirrer, a condenser, and the dropping funnel mentioned above was charged with 500 grams of water and 10 grams of gum arabic.

The toluene solution obtained as described above was dropwise added over 5 minutes through the dropping funnel described above while the aqueous solution was stirred at a rate of 3,000 revolutions per minute. After completion of this addition, the mixture was stirred for about 30 minutes at room temperature, and then the temperature was gradually raised. The mixture was maintained at the azeotropic temperature of water-toluene or higher to drive off the toluene. The time required for driving off toluene was 3 hours.

The toner particles were then separated by filtration by means of a No.2 filter paper and washed three times with warm water at 50° C.

The particles were then redispersed in 150 ml of isopropyl alcohol, and the toluene remaining within the toner particles was extracted. After separation by filtration, the toner particles were dried in a vacuum dryer at a temperature of 60° C. The average particle size of the pressure-fixable toner thus obtained was 11.6 microns, and the standard deviation was 1.32. The toner had excellent fluidity.

The encapsulation by the steps described above was completed, and the toner particles were washed with warm water. The toner particles were then redispersed in 150 ml of methanol in which 2 grams of a charge control agent Bontron S-32 (manufactured by Orient Kagaku, K.K., Japan) had been dissolved. Extraction of the residual toluene and surface treatment by means of the charge control agent were carried out. Thereafter, the toner particles were separated by filtration and dried.

The average particle diameter of the negatively charged pressure-fixable toner thus obtained was 12.1 microns, and the standard deviation was 1.34. The toner had excellent fluidity. The triboelectric potential between this toner and iron oxide powder (FEV 200/300; manufactured by Nippon Teppun, K.K., Japan) was −16 μc/g. Five parts by weight of this toner was mixed with 100 parts by weight of this iron oxide powder to prepare a two-component developer.

When this developer was applied to a selenium photoreceptor PPC electron copying machine having a pressure-fixing mechanism operated under a low pressure, i.e., linear pressure of 15 kg/cm, and when 50,000 continuous copies were made, fog-free clear copies having an image density of 1.5 or more were obtained. In this case, the fixable property, i.e., releasability, folding resistance, and abrasion resistance of the toner were equivalent to those of a heat-fixable toner. Further, no offset onto the fixing rolls in the continuous copy process and no filming to the photoreceptors or the carrier iron powder occurred.

COMPARATIVE EXAMPLE 1

The following components were kneaded by means of twin rolls, pulverized, and then classified to prepare a negatively charged toner.

| | |
|---|---|
| Microcrystalline wax (trade name ULTRAFLEX) | 65 grams |
| Carbon black (trade name Mitsubishi Carbon MA-100) | 5 grams |
| Styrene/methyl methacrylate copolymer used in Example 1 | 35 grams |
| Charge control agent (trade name Bontron S-32) | 5 grams |

When the resulting toner was evaluated as in Example 1, the pressure-fixable property was only of the order of 30% of a heat-fixable toner.

EXAMPLE 2

The following components were dissolved or dispersed in 100 grams of toluene and thereafter dispersed using DYNO-MILL.

| | |
|---|---|
| Polyethylene wax (manufactured by Perolite Company under the trade name POLYWAX 500) | 10 grams |
| Microcrystalline wax (trade name ULTRAFLEX) | 10 grams |
| Magnetic powder (manufactured by Toda Kogyo, K.K., Japan; magnetite having a particle size of 0.4 microns) | 60 grams |
| 70/30 Styrene/isobutyl methacrylate copolymer (molecular weight of 54,000) | 20 grams |

The dispersion was added to 150 grams of toluene to prepare a toluene solution, which was placed in a dropping funnel.

A pressure fixable toner for single-component development was obtained in the same manner as in Example 1.

The toner had an average particle size of 14.3 microns, and the standard deviation was 1.52. The toner had excellent fluidity. When this pressure-fixable toner was fed to Sibannet CP-55 (manufactured by Kyosera, K.K., Japan) and 5,000 continuous copies were made, fog-free clear copies having an image density of 1.5 or more were obtained. In this case, the fixability was excellent and approximately equal to that of a heat-fixable toner for two-component development. No offset onto fixing rolls in the continuous copy process was observed.

COMPARATIVE EXAMPLE 2

The toluene in Example 2 was replaced by ethyl acetate in an attempt to obtain encapsulation. However, the disperse system ruptured on heating, and it was impossible to carry out the encapsulation.

EXAMPLE 3

| | |
|---|---|
| Polyethylene wax (marketed by Petrolite Corporation under the trade name POLYWAX 500) | 70 grams |
| $C_5$-type petroleum resin (marketed by Mitsui Sekiyu Kagaku, Japan under the trade name Highlet G-100X) | 30 grams |
| Carbon black (the same as described in Example 1) | 5 grams |

The above mixture was kneaded for 15 minutes at a temperature of about 130° C. using a roll mill to prepare a core material. This core material (100 parts by weight) was dissolved, on warming, in toluene together with 20 parts by weight of a styrene-acryl copolymer which was to be a shell material of capsule. The subsequent procedure was carried out in the same manner as described in Example 1. That is to say, the resulting solution was added dropwise to a 2% aqueous solution of gum arabic; toluene was removed; in a filtering step the surface treatment of a toner was carried out with a methanol solution containing a metallized dye which was negatively charged charge control agent; and thereafter it was dried to obtain a negatively charged encapsulated toner for two component development. This toner (5 parts by weight) was mixed with 100 parts by weight of iron oxide powders to prepare a two component developer.

When this developer was applied to a selenium photoreceptor PPC electron copying machine having a pressure-fixing mechanism operated under a linear pressure of 15 kg/cm and when 5,000 continuous copies were carried out, there were obtained fog-free clear copies having an image density of 1.5 or more. Further, no offset phenomenon onto fixing rolls and no filming to photoreceptors or carrier iron powders occurred. Thus, an excellent fixable property was obtained.

COMPARATIVE EXAMPLE 3

| | |
|---|---|
| Polyethylene wax (marketed by Petrolite Corporation under the trade name POLYWAX) | 30 grams |
| Terpene-phenol copolymer resin (marketed by Yasuhara Yushi, Japan under the trade name YS Polystar 1225) | 10 grams |
| Magnetite (marketed by Toda Kogyo, Japan under the trade name EPT 500) | 60 grams |

The above mixture was kneaded for 15 minutes at a temperature of about 130° C. using a roll mill, and thereafter dissolved, on warming, in toluene together with 20 parts by weight of a styrene-acryl copolymer which was to be a shell material of capsule. The subsequent procedure was carried out in the same manner as described in Example 1. That is to say, the resulting solution was added dropwise to a 2% aqueous solution of gum arabic with stirring; toluene was removed; and the resulting particles were washed and dried to obtain a single component magnetic encapsulated toner having an average particle size of from 10 to 15 microns.

When this encapsulated toner was applied to a PPC electron copying machine having a pressure-fixing mechanism adjusted to a linear pressure of 15 kg/cm and when 1,000 copies were carried out, the quality of an image was stable and good. However, the fixing characteristics of the toner were poor in practicality. When a commercially available cellophane adhesive tape was affixed to the fixed image and then it was peeled off at a rate of 1.5 seconds per centimeter, the bulk of the toner was peeled off with the cellophane adhesive tape. It is believed the cause resides in the use of the terpene-phenol copolymer resin in place of the $C_5$-type petroleum resin.

EXAMPLE 4

30 grams of microcrystalline wax (marketed by Petrolite Corporation under the trade name ULTRAFLEX; melting point of 62° C.) and 1.5 grams of carbon black (marketed by Mitsubishi Kasei, K.K., Japan under the trade name Mitsubishi Carbon MA-100) were thoroughly molten and kneaded by means of heated rolls, and thereafter dissolved or dispersed in 100 grams of toluene. To this was added 10 grams of epoxy resin Epicoat 828 (trade name; marketed by Shell Petroleum Chemical Company) and they were mixed. Thereafter, the mixture was placed in a dropping funnel. A 1 liter cylindrical flask equipped with a stirrer, a condenser and the dropping funnel described above was charged with 400 grams of water, 6 grams of gum arabic, and 5 grams of triethylenetetramine. A core material having dissolved or dispersed microcrystalline wax, carbon black and epoxy resin in toluene was added dropwise from the dropping funnel described above over 15 minutes while this aqueous solution was stirred at a rate of 5000 revolutions per minute. The core material was then dispersed in the aqueous solution while stirring for about 60 minutes at room temperature. Thereafter, the dispersion was gradually heated to elevated the internal temperature of the flask to 80° C. After elevation, the temperature was maintained at 80° C.±1° C. over 6 hours to simultaneously carry out the curing reaction of the epoxy resin and the removal of toluene.

Thereafter, the toner particles were filtered off by means of a No.2 filter paper, and washed thrice with warm water at 50° C. They were re-dispersed in 100 ml of methanol and toluene included in the capsules was extracted in methanol. The toner particles were then filtered off and dried overnight in a vacuum dryer at a temperature of 60° C.

The average particle size of the encapsulated toner thus obtained was 16.7 microns and the standard deviation was 1.72.

When 30 grams of the encapsulated toner obtained and 270 grams of a carrier comprising iron powders of from 250 to 400 mesh coated with a resin were thoroughly mixed, then a non-fixing image was formed by means of an electron copying machine (marketed by Canon under the trade name NP-500) and thereafter this was pressure fixed under a linear pressure of 15 kg/cm, no offset onto the rolls was observed and a clear image was obtained. Also, in mixing the encapsulated toner with the carrier particles, no destruction of the capsule wall was observed. When this toner was stored for 7 days at a temperature of 50° C., no agglomeration of the toner particles occurred therebetween.

EXAMPLE 5

40 grams of polyethylene wax (marketed by Petrolite Corporation under the trade name POLYWAX 500; melting point of 86° C.) and 20 grams of magnetic powder (magnetite manufactured by Toda Kogyo, Japan; particle size of 0.4 microns) were thoroughly molten and kneaded by means of heated rolls. This was then dissolved or dispersed in 150 ml of toluene having dissolved 15 grams of epoxy resin Epicoat 152 (trade name; marketed by Shell Petroleum Chemical Comapny) therein. The resulting solution or dispersion was added dropwise under the stirring conditions of 4,000 revolutions per minute to a 50° C. aqueous solution wherein 8 grams of gum arabic was dissolved in 500 grams of water. The aqueous solution was maintained 30 minutes under such conditions.

To the aqueous solution obtained was then added 9 grams of Epicure Z (trade name; curing agent for epoxy resins manufactured by Shell Petroleum Chemical Company). The mixture was maintained for 30 minutes and gradually heated to elevate the internal temperature to 80° C. After elevation, the mixture was maintained at 80°±1° C. over 5 hours to simultaneously carry out the curing reaction of the epoxy resin and the removal of toluene.

Thereafter, the treatment was carried out in the same manner as described in Exmaple 4 to obtain an encapsulated toner.

The average particle size of the encapsulated toner thus obtained was 14.3 microns, and the standard deviation was 1.56.

When the resulting encapsulated toner (60 grams) was fed to the toner box of a 3M magne-dry copy machine (electron copying machine manufactured by Sumitomo 3M, K.K., Japan) and when a continuous copying test was carried out, there was no difference between the initial fixed image and the fixed image after 1500 copies. Filming onto the rollers, offset and fog phenomena were not observed, and a clear image was obtained. When minimum fixing pressure required for fixing of this encapsulated toner was measured using pressure-variable rollers, it was 10.3 kg/cm.

COMPARATIVE EXAMPLE 4

After completion of the curing reaction of the epoxy resin, the toner was spray dried in the same manner as described in Example 5 to prepare an encapsulated toner.

This encapsulated toner was used to form an image. Toluene odor was noticed from the resulting fixed image. When this toner was stored for 7 days at a temperature of 50° C., the toluene odor was still noticed and agglomeration of the toner particles was observed therebetween.

Further, polyethylene wax and magnetic powders used in Example 5 were molten and kneaded. The resulting blend was pulverized by means of a jet mill and then classified into from 5 to 25 microns to prepare a toner. When this toner was used to attempt fixing, offset was severe and a recording support was wrapped around the fixing roller. Thus, fixing cannot be carried out.

COMPARATIVE EXAMPLE 5

A molten blend consisting of 30 grams of microcrystalline wax (marketed by Petrolite Corporation under the trade name ULTRAFLEX) and 1.5 grams of carbon black (marketed by Mitsubishi Kasei, K.K., Japan under the trade name Mitsubishi Carbon MA-100); and 10 grams of Epicoat 1001 (trade name of an epoxy resin manufactured by Shell Petroleum Chemical Company) were dissolved or dispersed in a solvent mixture consisting of 250 grams of toluene and 250 grams of methyl ethyl ketone. Thereafter, the solution or dispersion was spray dried by means of a spray dryer (inlet temperature =170° C.; outlet temperature =140° C.; amount of air =9 $m^3$/minute; manufactured by Mitsubishi Kako, Japan) to prepare an encapsulated toner.

The encapsulated toner obtained was in the form of confetti; an outer wall in the form of film was not obtained; fluidity was inferior; and good fixed image was not obtained. Further, the average particle size was 32.4 microns and the standard deviation was 2.94.

COMPARATIVE EXAMPLE 6

40 grams of polyethylene wax (marketed by Petrolite Corporation under the trade name POLYWAX) and 20 grams of magnetic powders (magnetite manufactured by Toda Kogyo, Japan) were molten and kneaded. The blend was dissolved or dispersed in 150 grams of methyl ethyl ketone having dissolved 15 grams of Epicoat 1009 (trade name; marketed by Shell Petroleum Chemical Company) therein. The resulting solution or dispersion was added dropwise under stirring conditions of 1,500 revolutions per minute to a 50° C. aqueous solution wherein 8 grams of gum arabic was dissolved in 500 grams of water. Thus, the solution or dispersion was dispersed the aqueous solution.

The dispersed particles were then filtered off to prepare a toner without adding any curing agent for epoxy resins to the aqueous solution.

When the toner thus obtained was used to carry out the image formation, offset onto the fixing rollers occurred and thus an image cannot be fixed. When this toner was stored for 7 days at a temperature of 50° C., agglomeration of the toner particles was observed therebetween.

What is claimed is:

1. A process for producing a pressure-fixable toner which comprises the steps of: dispersing or dissolving a starting material mixture containing (a) a colorant and/or magnetic particles, (b) a pressure-fixable binding material selected from the group consisting of higher fatty acids, metallic salts of higher fatty acids, derivatives of higher fatty acids, amides of higher fatty acids, natural waxes, synthetic waves, rosin derivatives, polyolefins, olefin copolymers, silicone resins, alkyd resins, natural resin-modified phenol resins, maleic acid-modified phenol resins, phenol resins, rubber and styrene resins; and (c) a capsule wall-forming resin selected from the group consisting of homopolyumers of styrene or vinyl monomers, copolymers of styrene and vinyl monomers, and epoxy resins in an organic solvent; dispersing the resulting dispersion or solution in an aqueous dispersion-stabilizing solution; then gradually heating the thus-obtained dispersion up to the azeotropic temperature of the water-organic solvent to drive off the major portion of the organic solvent from the dispersed droplets and phase-separating the capsule wall-forming resin dissolved in the organic solvent on the surface of the dispersed toner droplets containing components (a) and (b) to form a capsule wall around the surface of the droplets; dispersing the resulting encapsulated toner in a lower alcohol to extract and remove the organic solvent remaining within the encapsulated toner; and thereafter drying the encapsulated toner.

2. The process according to claim 1 wherein said pressure-fixable binding material comprises (a) from 100 to 40% by weight of a material selected from the group consisting of higher fatty acids, metallic salts of higher fatty acids, derivatives of higher fatty acids, amides of higher fatty acids, natural waxes, synthetic waxes, rosin derivatives polyolefins, olefin copolymers, silicone resins, alkyd resins, natural resin-modified phenol resins, maleic acid-modified phenol resins, phenol resins, rubbers and styrene resins, and (b) from 0 to 60% by weight of petroleum resins obtained by polymerizing unsaturated hydrocarbons comprising aliphatic olefin and/or diolefin which have been obtained in a pyrolysis process of petroleum naphtha.

3. The process according to claim 2 wherein said petroleum resins are obtained by polymerization of unsaturated $C_5$ hydrocarbons and have a softening point of from 65° to 110° C.

4. The process according to claim 1 wherein said capsule wall-forming resin is a resin obtained by polymerizing from 50 to 100 parts of styrene and from 0 to 50 parts of vinyl monomers.

5. The process according to claim 1 wherein said capsule wall-forming resin is a epoxy resin cured by amine.

6. The process according to claim 1 wherein said organic solvent is toluene.

7. The process according to claim 1 wherein said lower alcohol is a member selected from the group consisting of methanol, ethanol, and isopropyl alcohol.

8. The process according to claim 1 wherein a charge control agent is previously dissolved or dispersed in the lower alcohol as needed.

* * * * *